US011001408B2

(12) United States Patent
Mabrey

(10) Patent No.: US 11,001,408 B2
(45) **Date of Patent: *May 11, 2021**

(54) CONTAINER FOR USE WITH TRANSPORTABLE MATERIALS

(71) Applicant: Halliburton Energy Services, Inc., Houston, TX (US)

(72) Inventor: James Butler Mabrey, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/831,515

(22) Filed: Mar. 26, 2020

(65) Prior Publication Data

US 2020/0223582 A1 Jul. 16, 2020

Related U.S. Application Data

(63) Continuation-in-part of application No. 16/123,792, filed on Sep. 6, 2018, now Pat. No. 10,654,634.
(Continued)

(51) Int. Cl.

| | |
|---|---|
| ***B65D 5/74*** | (2006.01) |
| ***B65D 5/468*** | (2006.01) |
| ***B65D 5/60*** | (2006.01) |
| ***B65D 5/54*** | (2006.01) |
| ***B65D 5/02*** | (2006.01) |

(Continued)

(52) U.S. Cl.
CPC ..... *B65D 5/742* (2013.01); *B31B 50/0044* (2017.08); *B31B 50/20* (2017.08); *B31B 50/25* (2017.08); *B31B 50/81* (2017.08); *B31B 50/84* (2017.08); *B65D 5/0227* (2013.01);
(Continued)

(58) Field of Classification Search
CPC .. B65D 77/064; B65D 5/0236; B65D 5/4608; B65D 5/60; B65D 5/703; B65D 77/062; B65D 2525/281; B65D 2571/00283; B65D 5/40; B65D 5/4208; B65D 77/06; B65B 5/024
USPC ..... 229/117.15, 117.16, 117.13, 117.27, 229/117.35, 117.3, 122.32; 222/105,
(Continued)

(56) References Cited

U.S. PATENT DOCUMENTS 2,177,919 A 10/1939 Vogt
2,312,598 A 3/1943 Sprague
(Continued)

*Primary Examiner* — Christopher R Demeree
(74) *Attorney, Agent, or Firm* — Tenley Krueger; Baker Botts L.L.P.

(57) ABSTRACT

A container with integrated handles provides an alternative to other containers handling materials. In some embodiments, the container includes an outer surface that encloses a cavity; a first face internal to the container; a second face internal to the container; a third face internal to the container; a fourth face internal to the container; an integrated handle including a first aperture disposed in the first face internal to the container and a second aperture disposed in the second face internal to the container and proximate to the first aperture; and an internal support disposed in the cavity, wherein the internal support traverses the cavity of the container to form a handle cavity by extending from the first face internal to the container to one or more faces internal to the container, wherein the internal support includes a handle cavity flap, a first binder flap, and a second binder flap.

18 Claims, 16 Drawing Sheets

Related U.S. Application Data

(60) Provisional application No. 62/581,108, filed on Nov. 3, 2017.

(51) Int. Cl.

| | |
|---|---|
| ***B31B 50/84*** | (2017.01) |
| ***B31B 50/81*** | (2017.01) |
| ***B31B 50/00*** | (2017.01) |
| ***B31B 50/25*** | (2017.01) |
| ***B31B 50/20*** | (2017.01) |
| ***B31B 120/40*** | (2017.01) |

(52) U.S. Cl.
CPC ..... *B65D 5/4608* (2013.01); *B65D 5/541* (2013.01); *B65D 5/60* (2013.01); *B31B 2120/40* (2017.08)

(58) Field of Classification Search
USPC ..... 222/465.1, 466; 220/495.06, 495.01; 141/10, 114; 53/175, 284.7, 512
See application file for complete search history.

(56) References Cited

U.S. PATENT DOCUMENTS

| | | | | |
|---|---|---|---|---|
| 3,160,326 | A | 12/1964 | Sturdevant et al. | |
| 3,765,574 | A | 10/1973 | Urquiza | |
| 3,952,940 | A | 4/1976 | Malcolm | |
| 4,793,494 | A * | 12/1988 | Gordon, Jr. ..... | B65D 5/325 229/117.16 |
| 4,974,773 | A * | 12/1990 | Alexander ..... | B65D 5/18 229/164 |
| 5,584,430 | A | 12/1996 | Mulry | |
| 7,681,783 | B2 | 3/2010 | Stephenson | |
| 7,984,845 | B2 * | 7/2011 | Kelly ..... | B65D 5/542 229/242 |
| 8,596,518 | B2 * | 12/2013 | Babcock ..... | B65D 5/4608 229/117.16 |
| 9,643,749 | B2 | 5/2017 | Wagner | |
| 9,751,656 | B2 | 9/2017 | Wolf | |
| 2013/0037432 | A1 | 2/2013 | Chang et al. | |
| 2014/0123604 | A1 | 5/2014 | Wagner | |
| 2019/0135516 | A1 | 5/2019 | Mabrey | |

* cited by examiner

| FEATURE | SIFT PROOF BOX | RSC BOX | VARIOUS INVENTION EMBODIMENTS |
|---|---|---|---|
| ERECTING & SEALING CAPITAL REQUIRED | $1M BOX LINE | $2500 TAPER | $2500 TAPER |
| INTEGRATED SINGLE HANDLE | YES | NO | YES |
| STIFFENERS OR REINFORCEMENT NEEDED | YES | NO | NO |
| SINGLE HAND POURING | NO | NO | YES |
| HANDLE CAVITY | NA | NO | YES |
| COMPLETELY LEAK PROOF | NO | YES | YES |
| POUR SPOUT | YES | NO | YES |
| MINOR FLAP PINCH CLOSURE | NO | NO | YES |
| COMPLETE EVACUATION OF GRANULES | NO | YES | YES |
| CONTACT AREA OF SINGLE HANDLE ON HAND | 2.25 $in^2$ | NA | 5.25 $in^2$ |
| SINGLE HANDLE LOAD DISPERSION @ 40 LBS. | 17.8 PSI | NA | 7.6 PSI |

*FIG. 23*

CONTAINER FOR USE WITH TRANSPORTABLE MATERIALS

CROSS-REFERENCE TO RELATED APPLICATIONS

The present application is a Continuation In Part of U.S. application Ser. No. 16/123,792 entitled "Container for Use With Transportable Materials", filed on Sep. 6, 2018, which claims the benefit of U.S. Provisional Application Ser. No. 62/581,108, entitled "Container for Use With Transportable Materials", filed on Nov. 3, 2017.

TECHNICAL FIELD

The present invention relates generally to packing, storing, stacking, displaying, handling and shipping a dense, free-flowing material, for example, granular clay. In particular, the present invention relates to an improved integrated handle and a pour spout for a Regular Slotted Carton.

BACKGROUND

Sift Proof Boxes (SPB) are designed to prevent leakage of particulate contents. Generally, the equipment required to erect, fill, and seal SPBs is expensive and complicated. A provider of SPBs generally will not provide other packing formats for free-flowing material. In general, SPBs are created using a full overlap (FOL) design and have become increasingly popular as a consumer package format for dry granules, dry powders, and semi-solids. Regular Slotted Cartons (RSC) require less expensive equipment to erect but require two hands to hold, lift, and pour as the RSCs do not include a single integrated handle. Presently, SPBs require two hands to hold, lift, and pour. An alternative to both glued FOL SPBs and taped RSCs with side handles is needed.

BRIEF DESCRIPTION OF THE DRAWINGS

FIG. 23 shows a chart comparing various boxes, according to one or more aspects of the present disclosure.

DESCRIPTION

Figure 1:
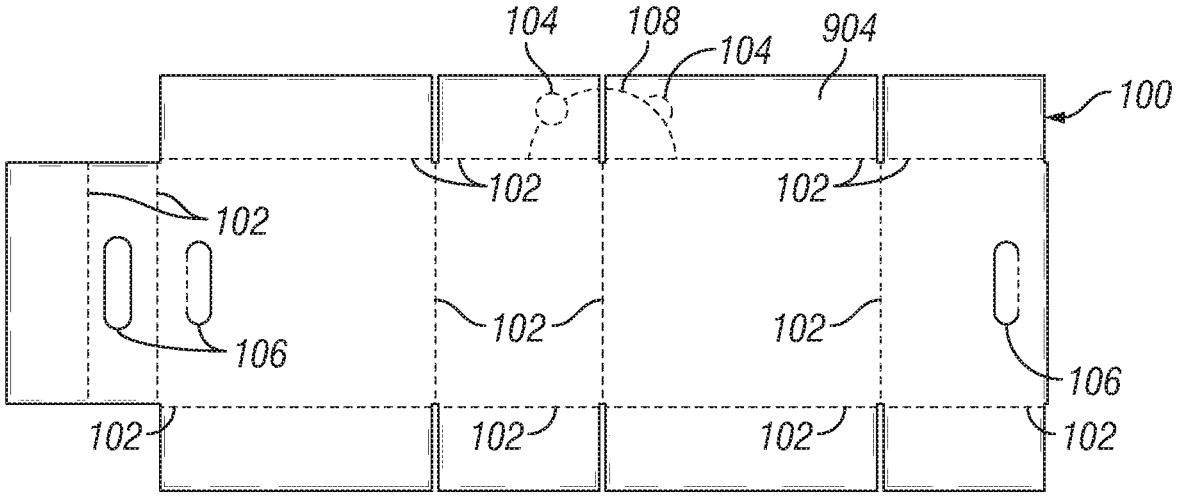
FIG. 1 shows a "die line" which represents where the cutting dies cut a Regular Slotted Carton box out of a sheet of corrugated paper, according to one or more aspects of the present disclosure.

In one embodiment, this invention provides a cost-effective method of packing, storing, stacking, displaying, handling and shipping a free-flowing material. The free-flowing material may be any desired material, for example, a dry granule, a dry powder, a semi-solid material, any other desired material fitting within the cavity of the container, and any combination thereof. In one embodiment, the free-flowing material may be a pet absorbent such as cat litter. In one embodiment, the invention provides an improved alternative to both glued full overlap (FOL) Sift Proof Boxes (SPB) and taped Regular Slotted Cartons (RSC) with side handles.

No Special Equipment Needed: The equipment needed to erect, fill, and seal SPBs is extremely expensive and complicated. Most companies that provide SPBs (for example Church & Dwight and Clorox Co.) will not provide other package formats (high density polyethylene (HDPE) jugs or pails). Once the incredible expense of purchasing, installing and operating the SPB line has been undertaken, the owner of the facility has few options other than to run SPBs, often exclusively. RSC boxes require less expensive equipment to erect, fill and seal, but RSC boxes do not offer a single integrated handle and require two hands to hold, lift, and pour. RSC boxes are generally referred to as "Bag-in-Box" systems in that they require a liner, such as a poly liner, to be placed into the box prior to filling. It is this liner that makes an RSC box leak proof. Companies that focus on private label packaging, like Bentonite Performance Mineral's Consumer Products Group (BPM CPG), have been asked by customers to provide a "box" that offers all of the attributes of the SPBs, but this needs to be done using BPM's existing manufacturing equipment. In one embodiment, the invention eliminates the need for specialized SPB erection and sealing equipment and allows BPM to use RSC box or even poly liner filling equipment.

Integrated Handle, Pour Spout: The attributes most associated with SPBs include an integrated handle and a pour spout. In one embodiment, this invention offers an alternative design that has an improved integrated handle and a pour spout. In one embodiment, the integrated handle and pour spout are disposed on a container including a first face, a second face, a third face, and a fourth face, wherein the integrated handle is disposed at the intersection of the first face and the second face and the pour spout is disposed at the intersection of the third face and the fourth face that is opposite to the integrated handle.

Improving Handle Integrity: The SPB handles often tear or fail under load, especially in the larger sizes from 25-50 lbs. In one embodiment, this invention aims to improve the integrity of the handle while under load.

Handle Ergonomics: SPBs use a poly or reinforced fiber (Tyvek) style handle between 1-2 centimeters (cm) in width. This places incredible stress on the hand and fingers while carrying and pouring. In one embodiment, the invention creates a far more comfortable handle that places the load over the full width of the hand and fingers.

Handle Placement: SPBs have the handle at the top of the box. This leads to a generally awkward position when using the handle to pour material out as two hands must be used to pour the material out. In one embodiment, the invention allows for a more balanced position of the box while pouring and for pouring using a single hand/arm. The consumer for cat litter is often middle-aged to older women and a well-placed, comfortable handle that does not require bending over is extremely important and necessary to this demographic.

Handle Cavity: In one embodiment, this invention integrates a design feature that creates a cavity allowing for the user's hand or fingers to be easily placed into the die-cut handle and prohibits the poly liner from interfering with placement of the hand.

Leakage: SPBs aim to be leak-proof, but with the heavy bulk densities of cat litter, they often rack when being picked up by the handle. It is common for the small granules to leak out the sides and out the top and bottom glued flaps. This results in a mess for the retailer and the consumer. In one embodiment, this invention uses a poly liner to guard against leakage. In one embodiment, this invention also ensures all granules can easily be evacuated from the box by removing the liner.

In one embodiment, the invention is an RSC constructed box that integrates a pour spout, integrated handle, and internal liner. The resulting product has the increased attributes of a FOL SPB but does not need to be erected, filled and sealed using a SPB manufacturing line. SPBs are viewed as a "premium" consumer package format because of the increased functionality of the handle and pour spout. RSC boxes require less complex packaging lines and can be erected by hand or with limited packaging equipment. In one embodiment, the invention has the attributes of a SPB and the simplicity in manufacturing of a RSC box.

Erecting & Sealing Capital and Equipment Required: SPBs require an elaborate and expensive, automated packaging system. These are expensive, temperamental, and can only be used to make SPBs. These lines require an automated box erector, then the bottom must be glued, the box filled with product, and then the top glued and placed in compression until the glue dries. These lines often have to be run continuously because the glue systems can seize if they are not operating continuously. Additionally, the SPBs are engineered, technical pieces of packaging in their own right. For example, the handle requires reinforcing, the boxes often have additional liners placed internally, and there are several pre-press items that have to be done by the corrugator (box manufacturer). In one embodiment, the invention is an RSC constructed box that may be erected using an automated box erector.

Integrated Single Handle: The handle is a feature making the SPB compelling and the RSC box generally undesirable for the consumer. In one embodiment, the invention combines the absolute best attributes of the SPB with the simplicity of design and ease of construction of the RSC.

No Stiffeners Needed: The main concern of many handle systems on corrugated boxes is having the handles tear off. By using the glue edge of the manufacturer's seam in one embodiment of the invention, the handle is effectively reinforced. Boxes have been trialed up to 40 pounds (lbs.), but 50 lbs. appears within range of a single-wall box. In one embodiment, the invention requires no stiffeners, composite materials, or reinforcement.

Single Hand Pouring: Neither the current RSCs or the SPBs allow for single hand pouring. The placement of the handle in one embodiment on the invention allows for balanced carrying of the box and allows for the user to lift the box to pour it in an ergonomic position where the material is balance and only one hand is needed.

Handle Cavity: To create a clear area to insert one's hand or fingers into the handle in one embodiment of the invention, a cavity has been created using the continued flap from the manufactured seam. In one embodiment, the continued flap can be folded back to create a triangle-shaped cavity which keeps the liner out of this area and creates room for one's hand or fingers. In one embodiment, the continued flap can be folded back to create a rectangular-shaped cavity which keeps the liner out of this area and creates room for one's hand or fingers.

Perforation Scores: To improve the coupling of certain flaps of a box to an inner portion of the box, one or more perforation scores are disposed or scored within a cavity of the box. The one or more perforation scores may include one or more scores, apertures, or perforations that penetrate through, partially through, or to any extent a face of the box to facilitate the coupling. In one embodiment, the one or more perforation scores are disposed on one or more faces within the cavity of the box. In one embodiment, the one or more perforation scores are formed by a cutting die cutting the box out of a sheet of corrugated paper.

Internal Support: In one embodiment, a handle cavity created using a continued flap from a manufactured seam provides an internal support which improves the structural integrity of the box. The internal support may be secured by coupling or binding the continued flap to any one or more of the one or more perforation scores. In one embodiment, the internal support forms a zigzag-shaped support within the cavity of the box.

Completely Leak Proof: Contrary to the name, SPBs do actually leak. The poly liner in one embodiment of the invention eliminates leakage. Liners are used in RSC but not in SPBs.

Pour Spout: Another compelling feature of a SPB is the pour spout. In one embodiment, the invention includes a novel way to add a pour spout. This pour spout allows for access to the liner. Pour spouts are used on SPBs, but BPM is not aware of any "tear-off" pour spouts being used on RSCs.

Pinch Closure: In one embodiment, the invention integrates a pinch closure of the liner. By folding the top of the liner through a lower flap "cleat", the liner top can be sealed off. This means that the liner doesn't need to be heat sealed during packaging yet will remain leak-proof. In one embodiment, the invention also includes an alternative design using an "X" shaped pinch point. After running the liner through the pinch point, the top is folder through a notch to create a full seal.

Single Handle Contact Area/Load Dispersion: The single handle of a SPB is actually painful to use when weights of the boxes begin to exceed 20 lbs. In one embodiment, the invention manages to disperse the load over a much larger area making it far easier to carry 20-40 lbs. packages for an extended period of time.

In one embodiment, the proposed invention also allows for manufacturing with virtually no capital investment to the manufacturing lines.

In one embodiment, the invention should have functionality in markets where manufacturers and consumers need the attributes of a pail but with the cost-effective method of packing, storing, stacking, displaying, handling and shipping.

FIG. 1 is a "die line" in one embodiment of the invention which represents where the cutting dies cut one embodiment of the invention out of a sheet of corrugated paper 100 (card board). Fold lines 102 are represented by the dotted lines. This is a version of a Regular Slotted Carton (RSC) box. In one embodiment, the invention has three vertical hand holds (cut-outs 106 form the vertical hand hold) which allows for the box to have an integrated single handle. The semi-circle 108 on the upper flap 904 is a pour spout which is removed by placing a finger into the circle 104 and lifting up to remove a portion of the flap. For example, the perforations formed by semi-circle 108 form an area that is removable by placing a finger into the circle 104 and lifting up which removes the perforated portion of the outer surface of the RSC box 200 as shown in FIG. 2.

Figure 2:
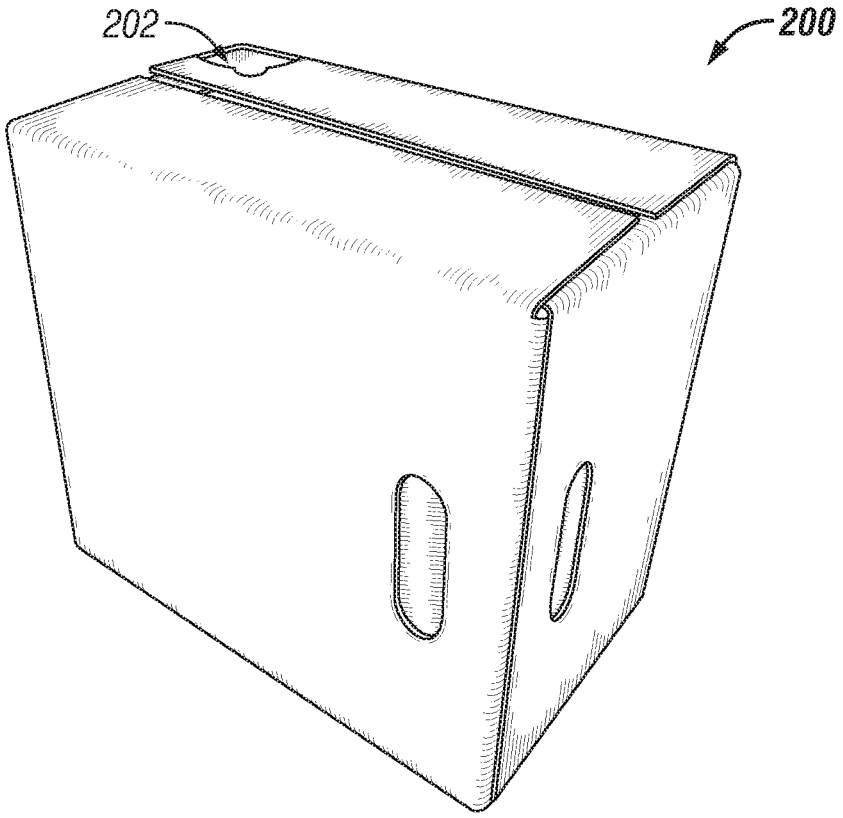
FIG. 2 shows an assembled Regular Slotted Carton box, according to one or more aspects of the present disclosure.
Figure 3:
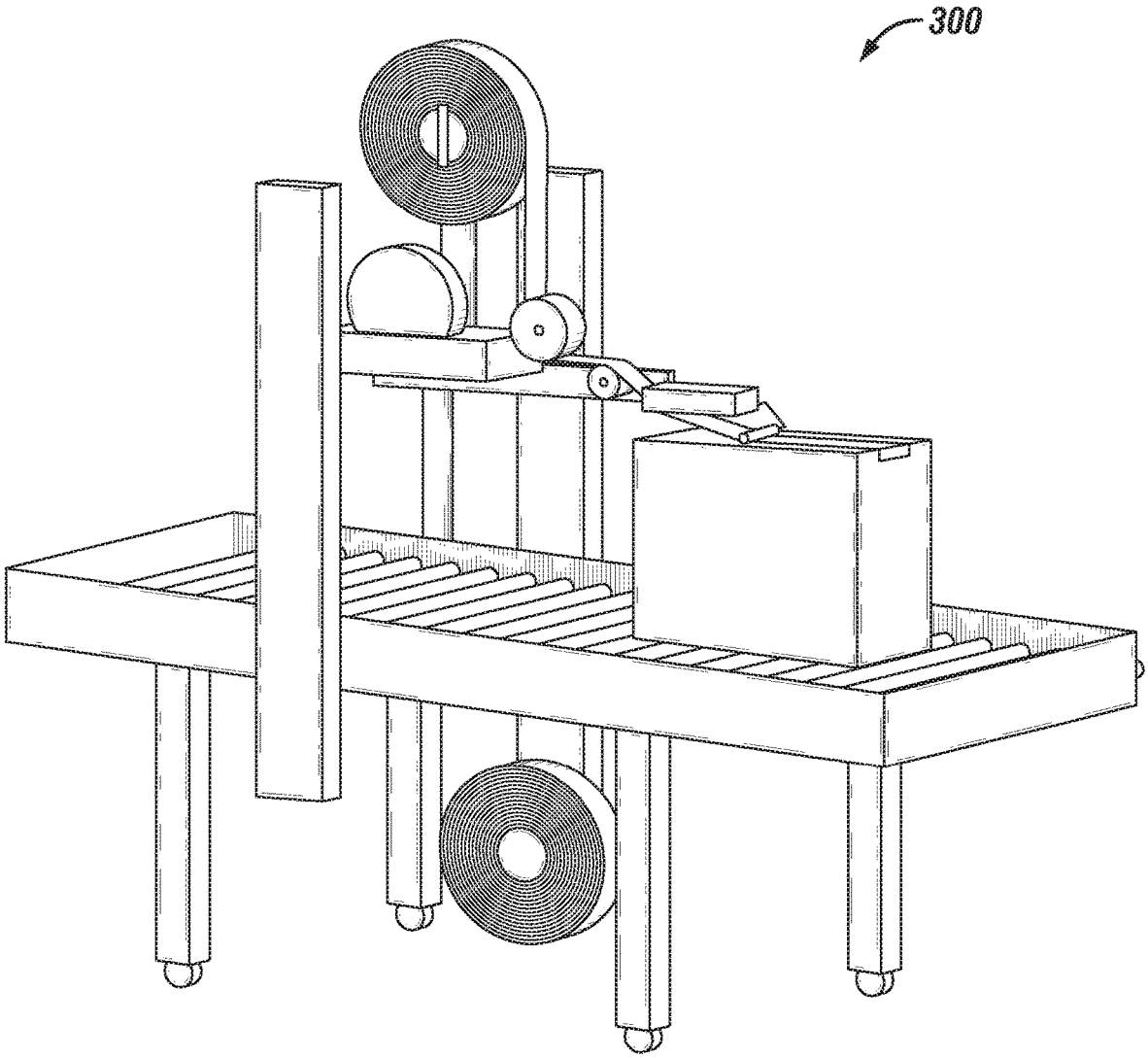
FIG. 3 shows equipment to seal an assembled Regular Slotted Carton box, according to one or more aspects of the present disclosure.

FIG. 2 shows one embodiment of the assembled invention (RSC box 200) with the pour spout 108 partially removed to form opening or spout 202. The equipment needed to seal the box 200 is a "top and bottom taper" 300 as shown in FIG. 3. The box 200 can be erected and lined manually. It can be filled using volumetric net weighers and other standard filling equipment. The low cost of box tapers 300 allows for one embodiment of the invention to be a design that could be manufactured in almost any facility due to the accessibility of the tapers and ability of the design to seal dry powders and granules without leaking.

Figure 4:
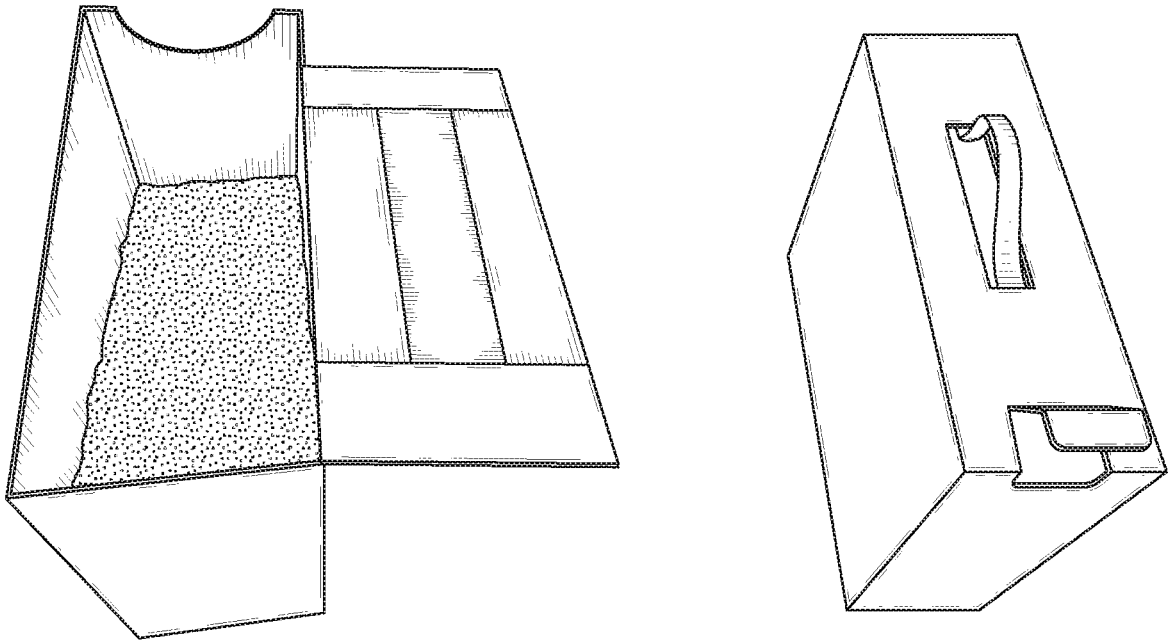
FIG. 4 (Prior Art)
FIG. 4 shows prior art Sift Proof Boxes.
Figure 5:
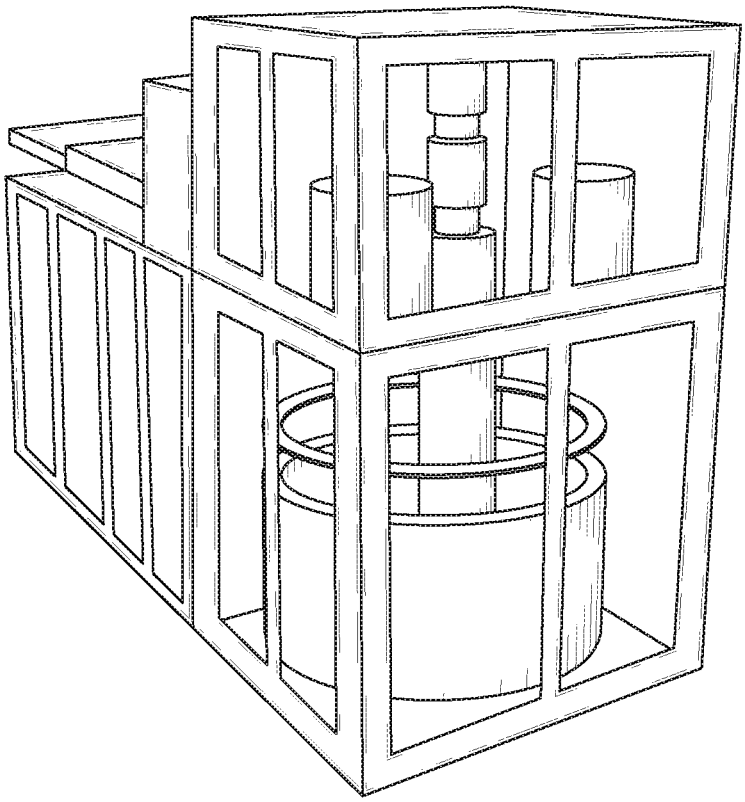
FIG. 5 (Prior Art)
FIG. 5 shows a prior art Sift Proof Box manufacturing line.

FIG. 4 shows the current competitive FOL SPBs. SPBs were originally created for packaging detergents and other dry powders. SPBs require a very expensive packaging line to erect and seal. A small SPB line is shown in FIG. 5. These lines require a hot-melt glue system and a large footprint as the boxes must be kept in compression during sealing of the bottom flaps before filling and then must again be placed in compression to seal the top flaps. The hot-melt system is particularly difficult to maintain as some designs must be running continuously to function properly. SPBs are also very heavily engineered items. In FIG. 4 you can see the integrated handle and how this must be applied and reinforced from the bottom of the top flap. This reinforcement is expensive and must be performed by the corrugated box supplier. SPBs often require additional reinforcement of the box body or in other places of the SPB. This can be seen as the inner box on the left most sample in FIG. 4. The reality of SPBs is that very few corrugated box suppliers can manufacture the package so the number of vendors is limited and pricing is significantly higher than RSC boxes.

Figure 6:
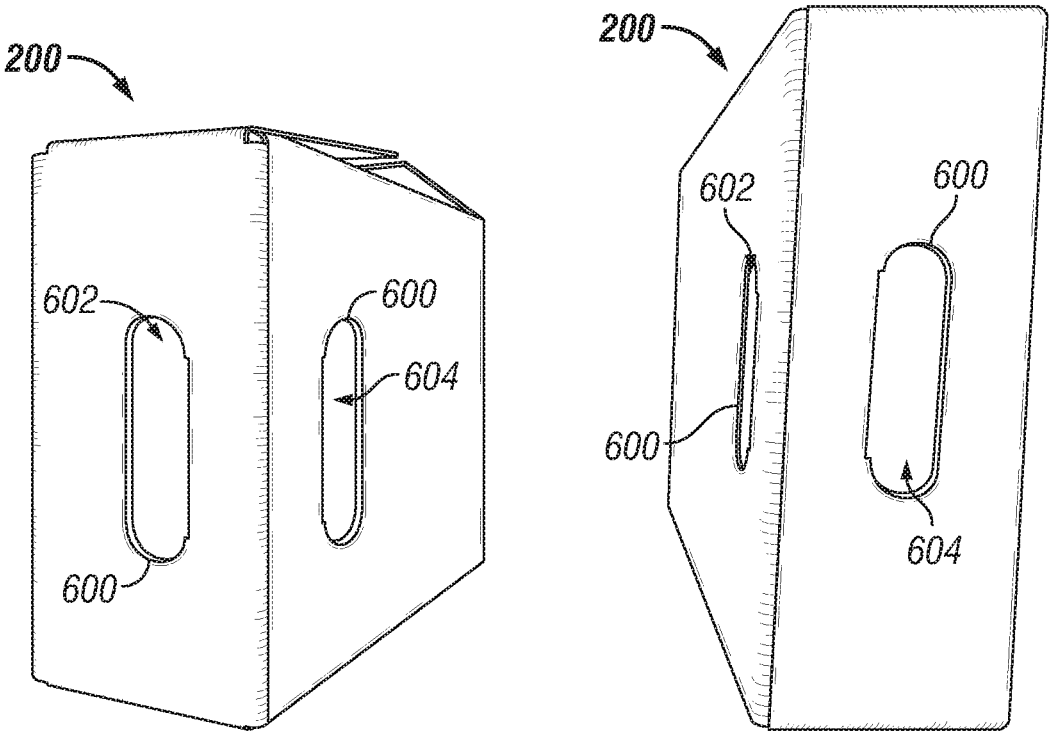
FIG. 6 shows an integrated handle for a Regular Slotted Carton box, according to one or more aspects of the present disclosure.

FIG. 6 details an integrated handle 600 for a RSC box 200. RSC boxes generally do not have a single integrated handle. In one embodiment, the invention specifically uses the glued manufactured seam on the box to create the integrated handle 600. The integrated handle 600 includes a first aperture 602 and a second aperture 604. The first aperture 602 is in the outer surface of the RSC box 200 with an area sufficient to allow insertion of one or more fingers and the second aperture 604 is in the outer surface of the RSC box 200 with an area sufficient to allow exit of one or more fingers. Either hand or one or more fingers may be inserted on either side of the first aperture 602 and the second aperture 604. That is, the first aperture 602 and the second aperture 604 are designed for both left-facing and right-facing use. The second aperture 604 is positioned sufficiently proximate to the first aperture such that the one or more fingers inserted into the first aperture can or are permitted to exit the second aperture. The other corners of the box could be used for handles, but the glued manufactured seam is the strongest and allows for a single wall box to hold up to 50 lbs. from the handle. In one embodiment, the invention allows an RSC to mitigate and compete much more cost effectively against SPBs.

Figure 7:
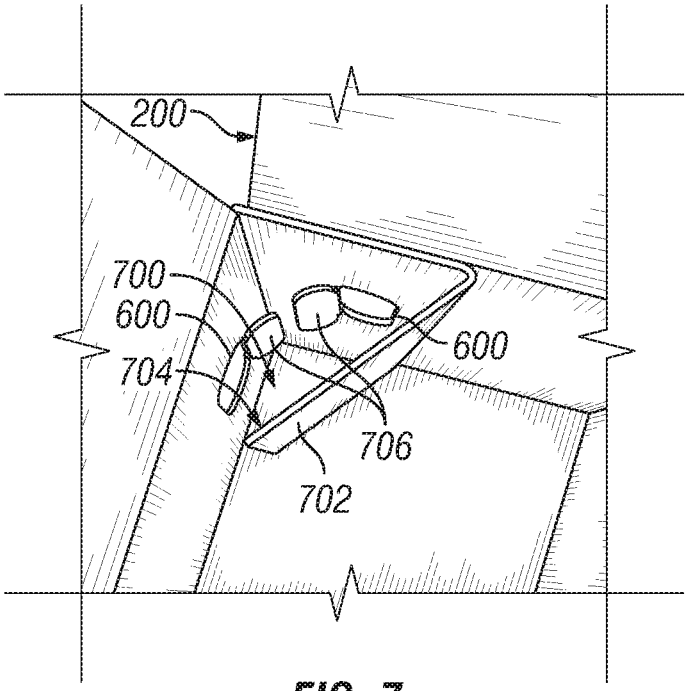
FIG. 7 shows a handle cavity for a Regular Slotted Carton box, according to one or more aspects of the present disclosure.

FIG. 7 shows the handle cavity 700 for a RSC box 200. This box 200 has a poly liner to make it leak-proof, and a system 702 is used to keep the poly liner from pushing against the die cut hand holds. Without the handle cavity 700, it could be difficult to insert one's hand or fingers into the box handle 600. Also, without the cavity 700, if the user pressed hard against the die cut hand hold flaps 706, it is possible to cut the poly liner with the flap 706 or push a finger through the liner. In one embodiment, the invention's cavity 700 solved this problem. First, it creates an internal dead space where the user's fingers and thumb can be inserted, the fingers meet no resistance from the internal poly liner, and the die cut flaps 706 can swing open without being encumbered. The cavity 700 is created by running the corrugated sheet longer along the manufactured seal. It is folded back diagonally to create a triangular column 704. This column 704 also creates additional vertical support. This may (or may not) allow for a slightly lower grade box to achieve increased stacking strength.

Figure 8:
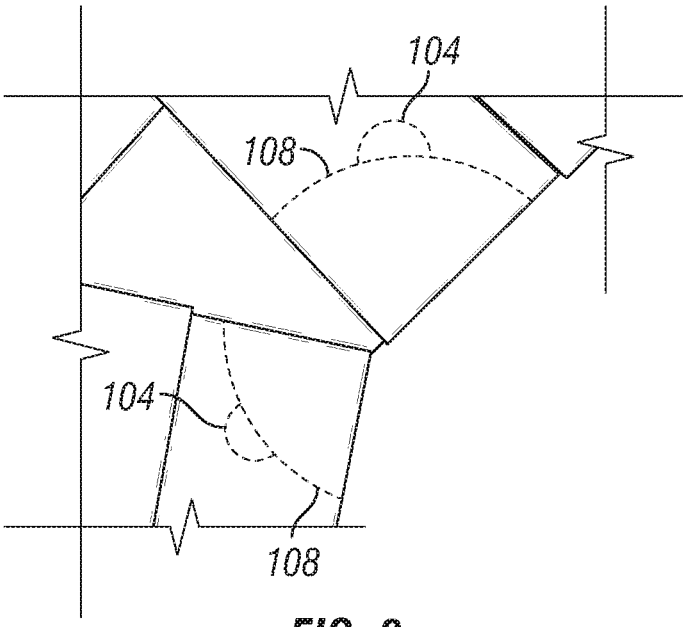
FIG. 8 shows a die cut spout for a Regular Slotted Carton box, according to one or more aspects of the present disclosure.
Figure 9:
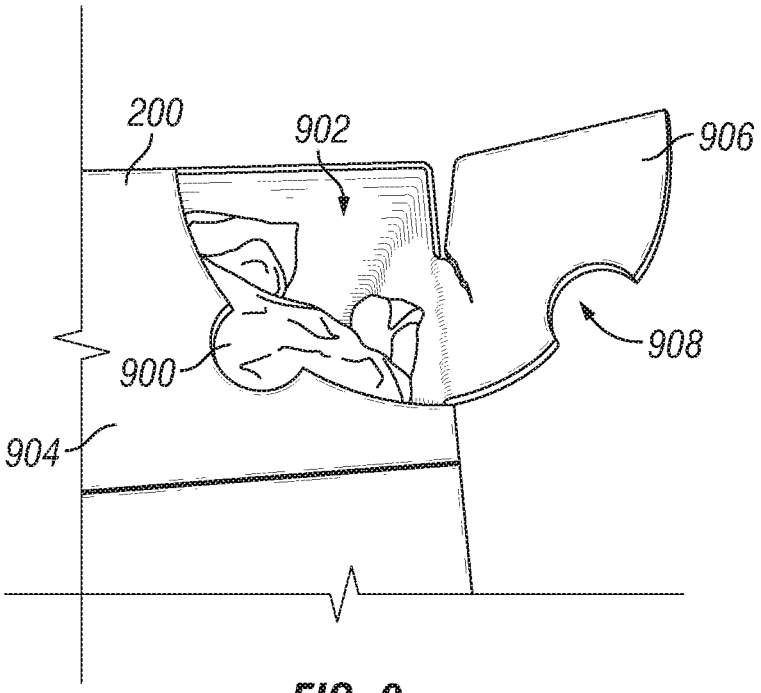
FIG. 9 shows a torn pour spout for a Regular Slotted Carton box, according to one or more aspects of the present disclosure.
Figure 10:
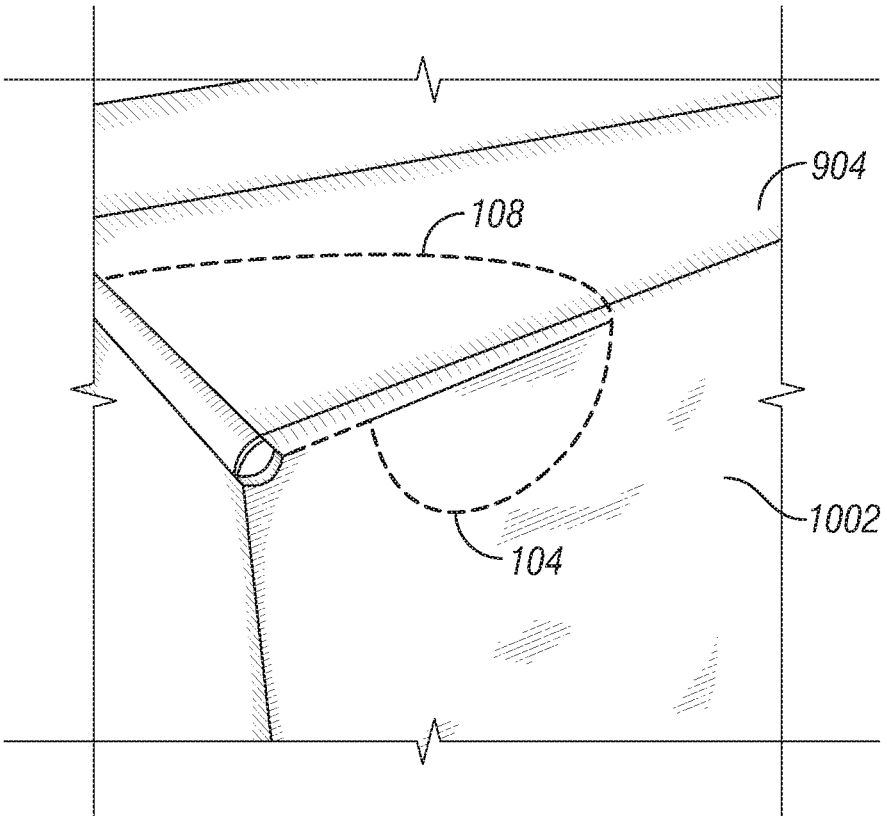
FIG. 10 shows a side facing finger hole for a Regular Slotted Carton box, according to one or more aspects of the present disclosure.

FIG. 8 shows the detail of the die cut spout 108. The smaller semicircle (tear spot 104) on the top of the larger semicircle die cut spout 108 is a place to insert a finger or thumb. For example, an opening 908 is created by tearing along the perforation of the tear spot 104. This tear spot 104 can also be placed or disposed on the upper flap 904 (FIG. 9) or in the face 1002 of the box (FIG. 10), according to one or more aspects of this disclosure. This allows for the user to open or tear away a portion 906 to form the spout 902 as illustrated in FIG. 9. The top of the poly liner 900 is accessible via the spout 902 once the die cut spout 108 is removed as portion 906 (FIG. 9). The user pulls the liner 900 out of the spout 902 and can then pour from the box 200. A spout 902 is formed in the same manner in FIG. 10 as illustrated in FIG. 9 with the spout 902 being formed on the upper flap 904 when the tear spot 104 on the face 1002 is used to tear along the die cut spout 108.

Figure 11:
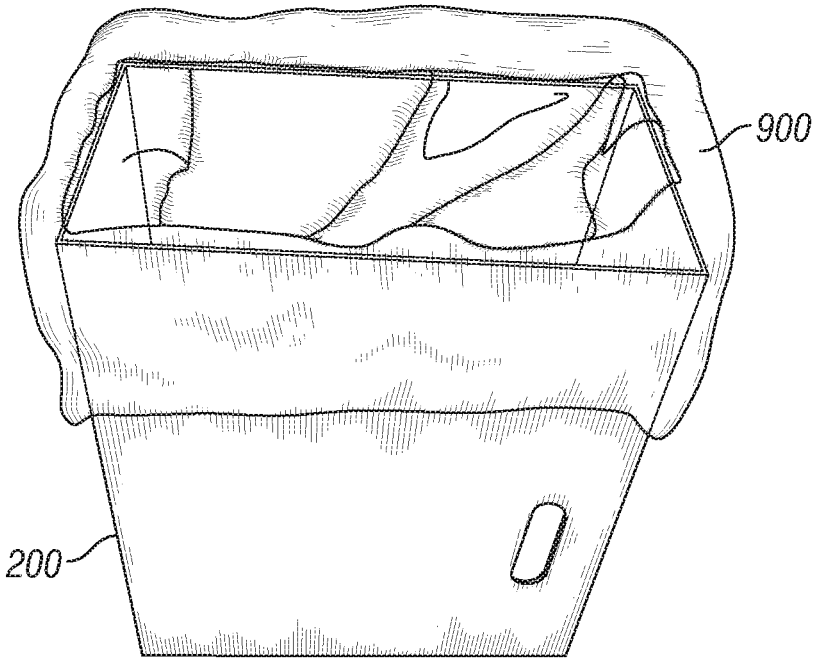
FIG. 11 shows an internal liner for a Regular Slotted Carton box, according to one or more aspects of the present disclosure.
Figure 12:
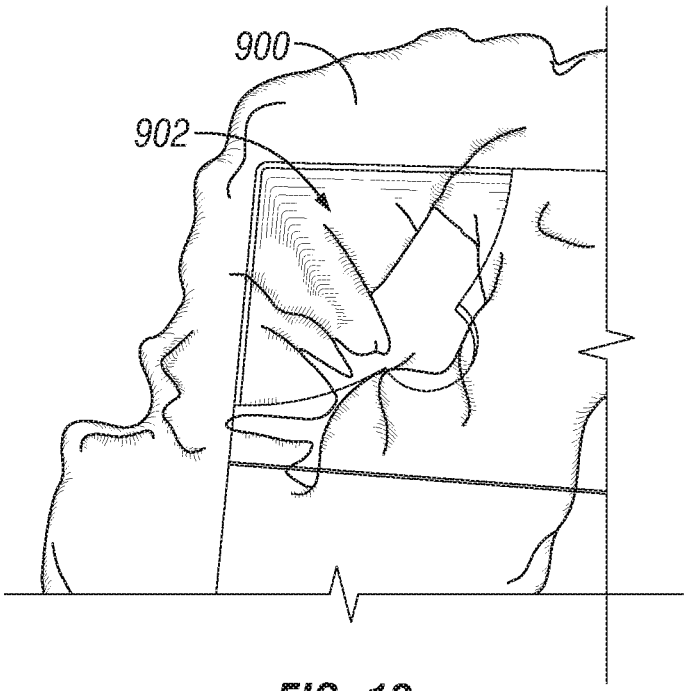
FIG. 12 shows a liner opened via the spout for a Regular Slotted Carton box, according to one or more aspects of the present disclosure.

RSC boxes 200 can effectively be made "leak-proof" with a poly liner 900 as seen in FIG. 11. These liners 900 can be placed manually or with semi or automated box lining equipment. FIG. 12 shows the liner being opened via the spout 902. This must be done prior to pouring out the granules the box holds and would be performed by the consumer. One other benefit to this liner 900 is that the entire liner 900 can be removed through the spout 902 and every granule can be evacuated from the liner.

In one embodiment, the invention uses a novel way to effectively seal a liner, such as a poly liner, using just the box flaps. Most poly liners need to be sealed with a heat sealer or have a clamp or twist-tie applied to the liner. This adds time and complexity during the sealing of the poly liner. In one embodiment, the invention offers two potential designs that allow the poly liner to be pulled through a "cleat" or through an "X" shaped pinch closure 1300 of FIG. 13 created using the minor flap 1304 of the box 200. The folding over of the poly liner and the taping down of the top flap seals the poly liner without additional, specific poly liner closures. The design allows for the consumer to remove the tear spout 108 and have access to the top of the poly liner. The consumer can then easily open the liner and pour the material out without removing the top tape that is used to secure the top flaps.

Figure 13:
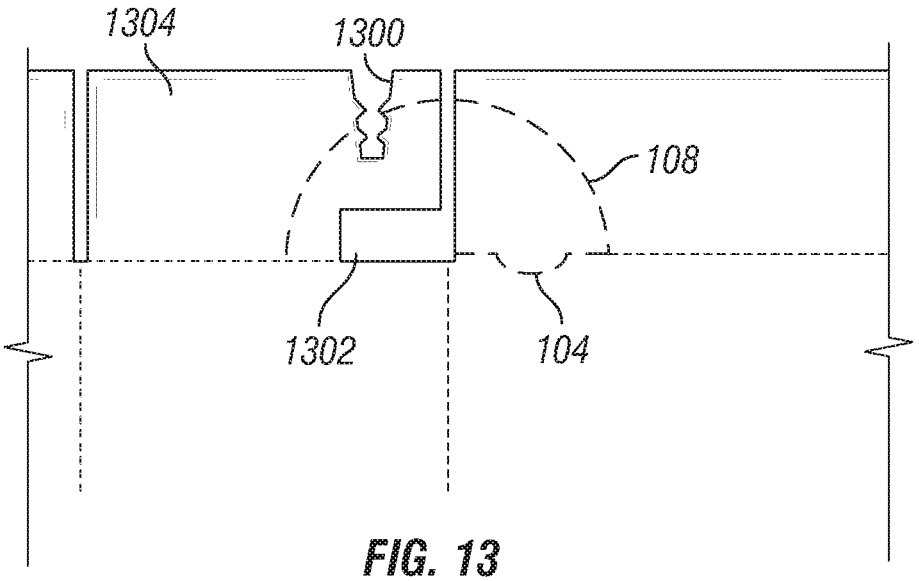
FIG. 13 shows a notch and cleat for pulling a liner through for a Regular Slotted Carton box, according to one or more aspects of the present disclosure.
Figure 14:
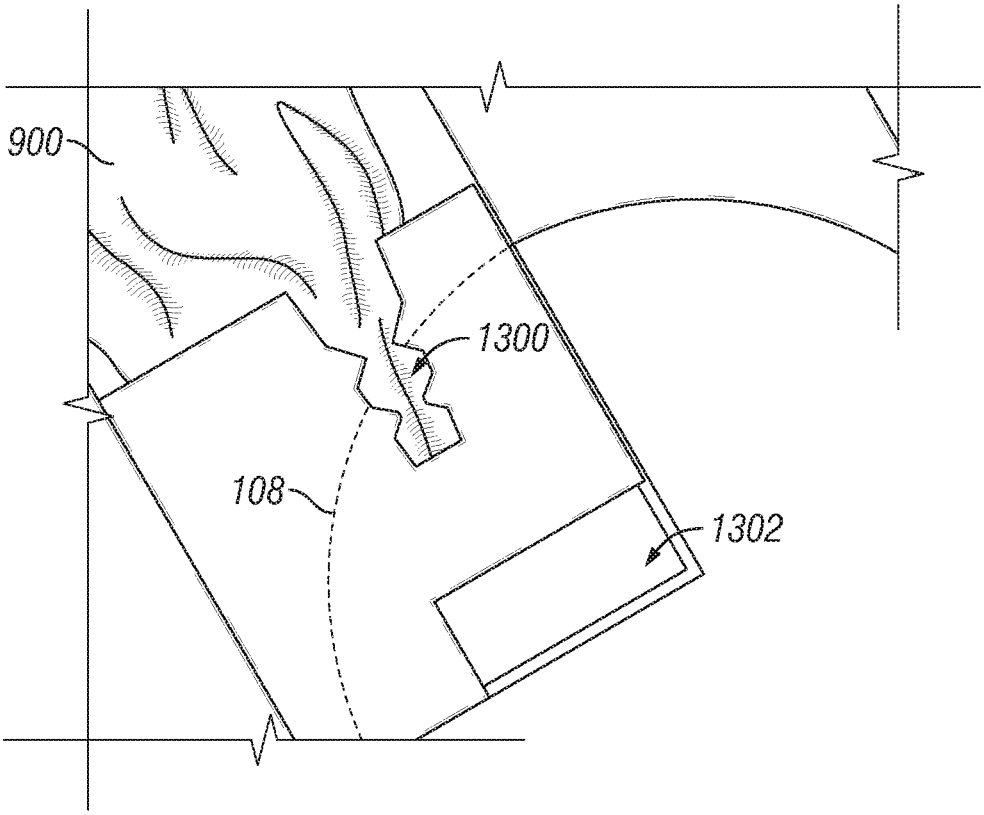
FIG. 14 shows a notch and cleat for pulling a liner through for a Regular Slotted Carton box, according to one or more aspects of the present disclosure.
Figure 15:
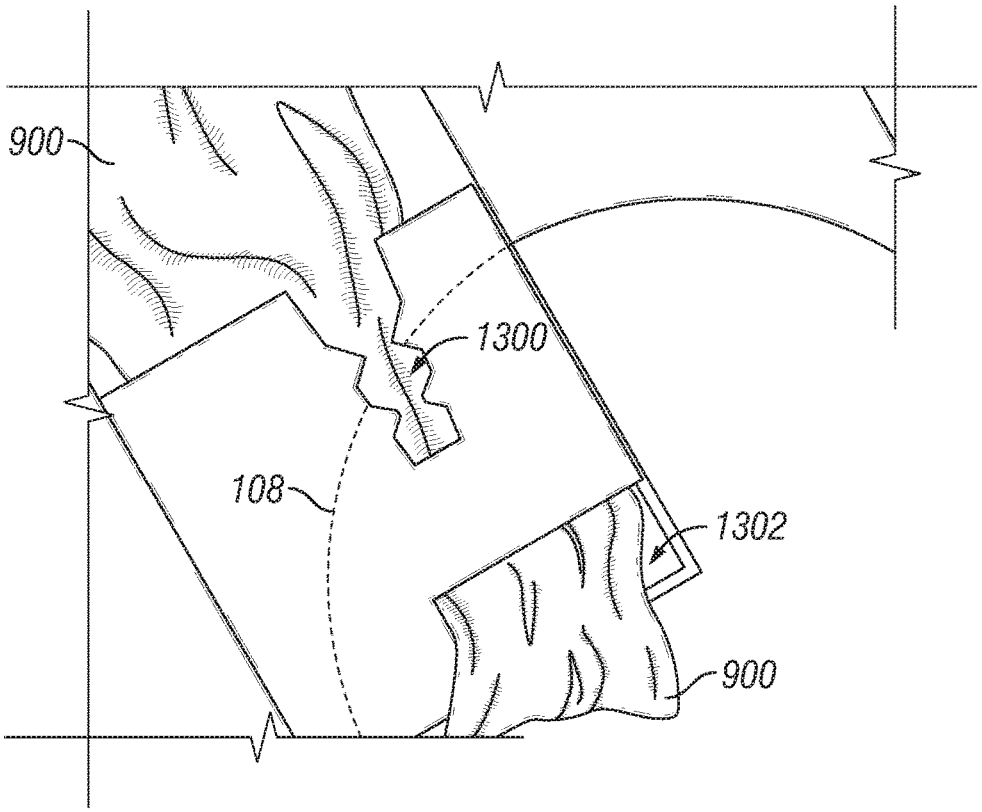
FIG. 15 shows a notch and cleat for pulling a liner through for a Regular Slotted Carton box, according to one or more aspects of the present disclosure.
Figure 16:
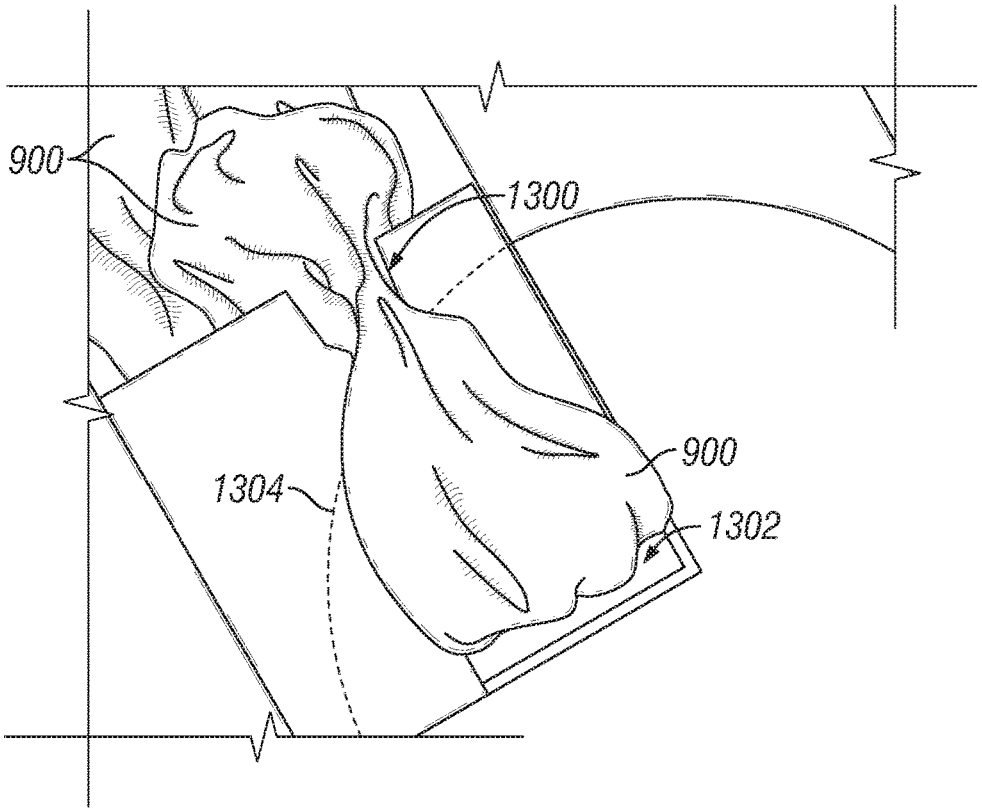
FIG. 16 shows a liner or poly liner pulled through a notch and folded through the cleat of a Regular Slotted Carton box, according to one or more aspects of the present disclosure.

FIG. 13 shows a general design by which the minor flap 1304 is notched with a notch 1302. FIG. 14 shows a sample of the design and includes marking for the dies cuts and perforations 108 for the spout. During manufacturing, the person filling the box will take the poly liner 900 and pull through the notch 1302 (FIG. 15). The top of the poly liner 900 is then folded through the cleat 1300 (FIG. 16) and secured. Then the Major flaps are folded down and the box is secured with a single piece of tape across the top of the box. When the box is picked up by the handle, the weight of the contents in the poly liner will push against the folded top of the liner creating a leak-proof seal.

Figure 17:
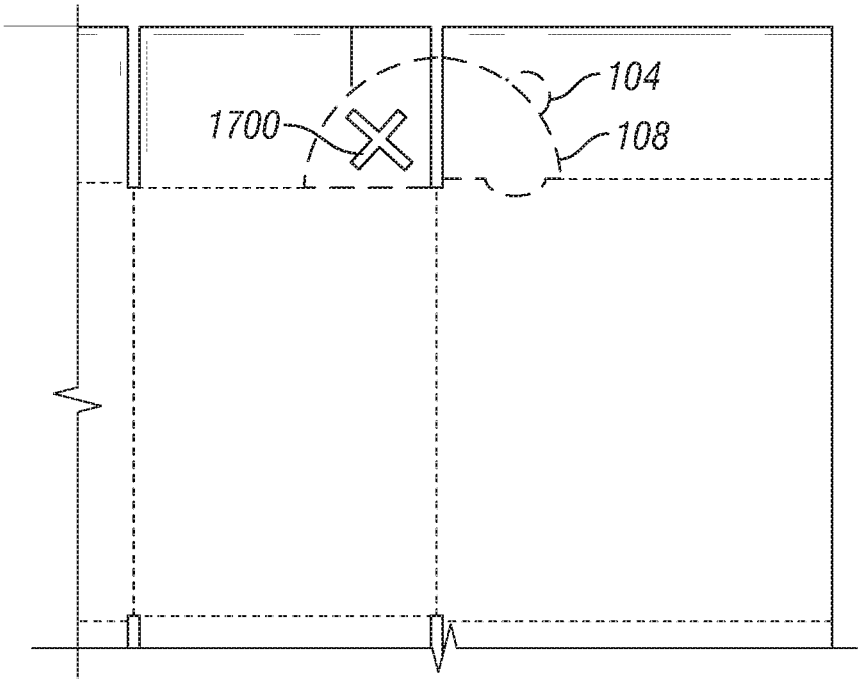
FIG. 17 shows an "X" shaped closure for a Regular Slotted Carton box, according to one or more aspects of the present disclosure.
Figure 18:
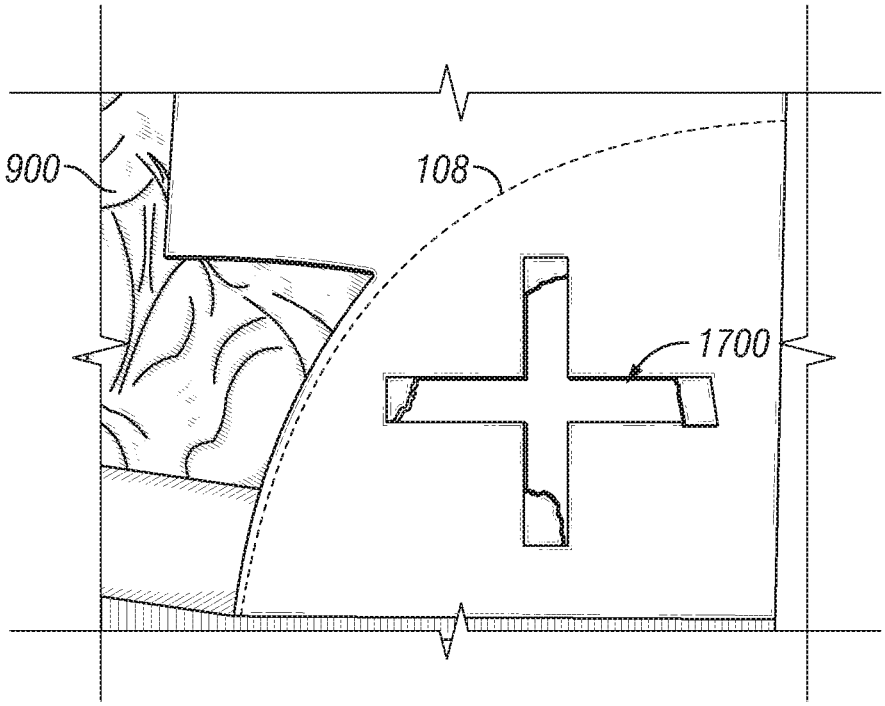
FIG. 18 shows an "X" shaped closure and die cuts for a spout for a Regular Slotted Carton box, according to one or more aspects of the present disclosure.
Figure 19:
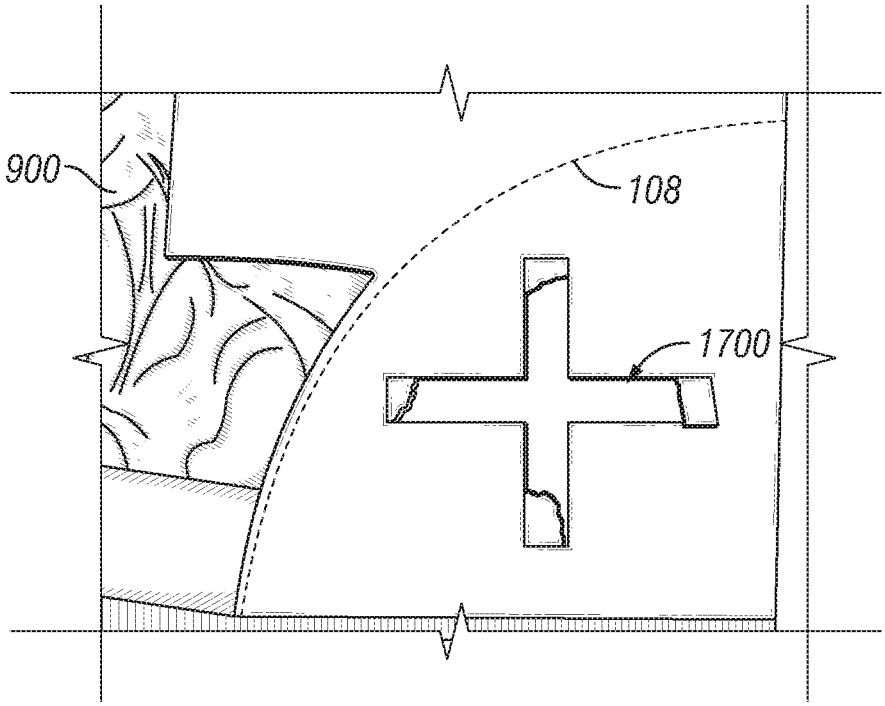
FIG. 19 shows an "X" shaped closure and die cuts for a spout for a Regular Slotted Carton box, according to one or more aspects of the present disclosure.
Figure 20:
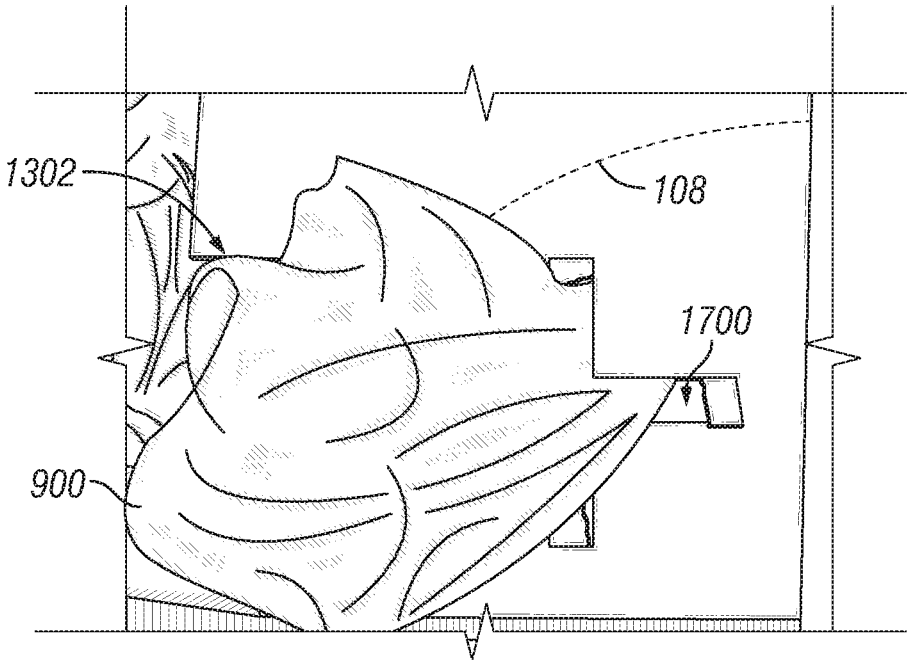
FIG. 20 shows an "X" shaped closure with a liner or poly liner pulled through, according to one or more aspects of the present disclosure.

FIG. 17 shows an alternative design using an "X" shaped closure 1700. FIG. 18 shows a mock-up of this design and includes the die cuts 104 and perforations 108 for the spout. During manufacturing, the person filling the box will take the poly liner 900 and pull it through the "X" 1700 (FIG. 19). Then, the top of the poly liner 900 is folded over and into the notch 1302 (FIG. 20). The major flaps 2100 are folded down and the box is secured with a single piece of tape 2102 across the top of the box as illustrated in FIG. 21.

By using either design, the top of the liner 900 is instantly accessible when the spout is opened.

Figure 22:
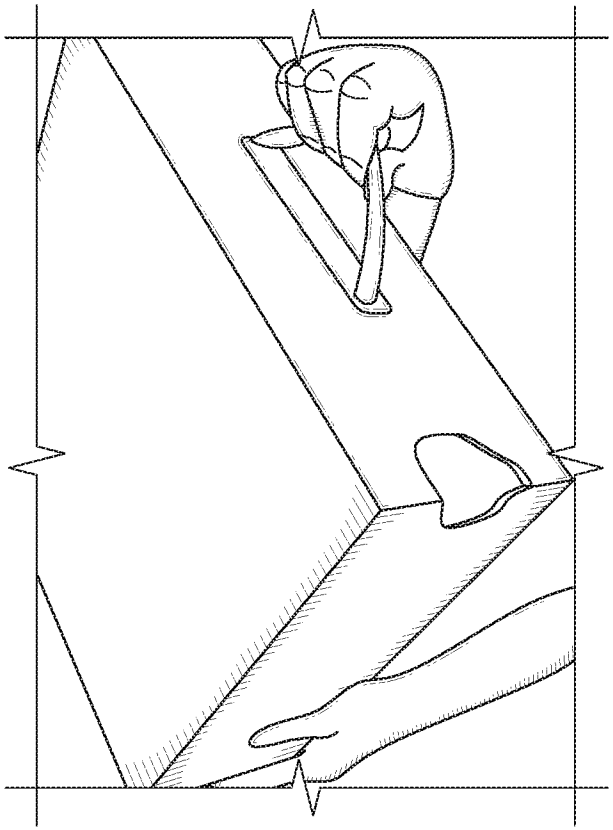
FIG. 22 (Prior Art)
FIG. 22 shows a prior art Sift Proof Box which requires two hands for pouring contents.
Figure 21:
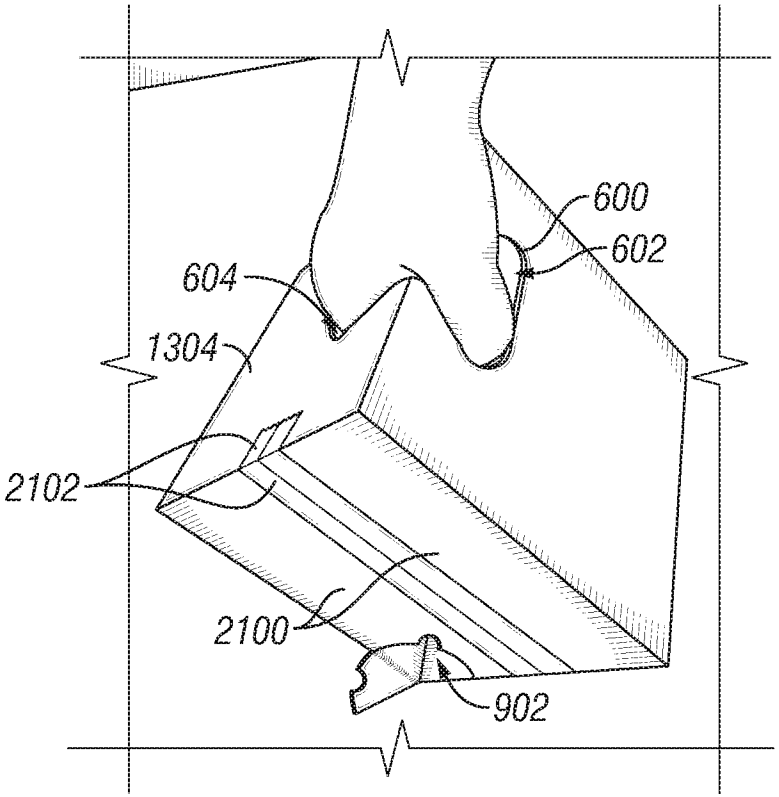
FIG. 21 shows a Regular Slotted Carton box assembly for carrying, according to one or more aspects of the present disclosure.

FIG. 21 shows an element of one embodiment of the invention regarding being able to carry and pour the box using a single hand/arm. For example, a hand may be inserted into integrated handle 600 and contents of the box may pour via spout 902. In contrast, traditional SPB designs do not allow for pouring with a single hand. FIG. 22 shows how a user holding the SPB from the top handle and then using their other arm to hold the bottom or bottom corner and twist to pour the material out. This is a cumbersome posture and places stress on the hand holding the top handle. In one embodiment, the invention allows for a completely balanced pouring position. In one embodiment, the invention's handle is much wider than a SPB poly handle (FIG. 4 and FIG. 22). In fact, the pressure exerted on the hand with one embodiment of the invention is calculated to be 58% less than with the SPB. Cat litter is an extremely dense material and it is not uncommon to have boxes up to 42 lbs. SPB's poly handle place an uncomfortable amount of stress on the hand and fingers. In one embodiment, the invention's wider handle allows for users to not only pour comfortably, but users can carry the package for longer periods of time without the same level of fatigue or discomfort.

FIG. 23 shows comparison of features of various boxes. The following features can be included in embodiments of the invention:

Minimal erecting and sealing equipment required (low capital outlay)

Integrated single handle

No stiffeners or additional reinforcements needed for the box or the integrated handle Single hand pouring Handle cavity Tab and lock for handle cavity flap Completely leak proof Pour spout Pinch liner closure using "Cleat" or "X" closure using minor flap Low PSI handle pressure Any industry that requires an efficiently stacked, stable pallet in either simple corrugated or full-color graphics could employ an embodiment of this box as an excellent delivery vehicle for its product. Powder or granules could be shipped, transported, and marketed in this format with minimal equipment investment.

The sustainable nature of compostable and recyclable corrugated boxes could make them especially desirable to industries looking to minimize their dependency on plastic pails.

Several alternatives are available for embodiments of the invention, including:

Minimal erecting and sealing equipment: Alternative—Companies could use high-speed, fully or semi-automated RSC box and bagging lines.

Integrated single handle: Alternative—A design could be created with the handle on the face, two handles on the corner, or multiple handles on the box to try to integrate a handle on a RSC box.

No stiffeners or additional reinforcements needed for the box or the integrated handle: Alternative—Stiffeners or additional reinforcements could be used to move the handle around, make the box stronger, or expand the design to double wall boxes or other composite package types.

Single hand pouring: Alternative—Companies could use plastic handles or adhesive handles to create a handle system. Companies could try single finger holes.

Handle cavity—An inner liner is thermoplastically molded polyethylene. This blow-molded liner allows for a handle cavity. But, like a handle design, it would seem that any alternative could be pre-applied to the box or part of a two-step process.

Completely leak proof—spray or glue applied to the crevices prior to filling. An alternative cavity could be created and sealed if one wanted the same hand-hold design but without the liner.

Pour spout—There are all types of pour spout systems that could be created. Systems exist where corrugators embed other materials to create pull tabs and tear strips.

Pinch closure cleat—A semi or fully automated "bag-in-box" packaging line could have various other sealing options.

Low PSI handle pressure—RSC boxes can come with side hand holds. SPBs could use wider poly handles.

Tab and lock system on handle cavity—A tab on the handle cavity flap secures in a lock or slit on a flap of the RSC box to form the handle cavity and to prevent damage to the liner during assembly and use of the integrated handle.

Hybrid Box Design—An alternative design would be for a box that has some elements of an RSC and some elements of an SPB with FOL flaps. Such a design could have a taped bottom and a glued top flap. Or a glued top and bottom, but still used a liner and the integrated side handle (not a top handle as currently used in SPBs). The SPB's full-overlaps make for a cleaner top area and remove the need for the minor flaps. In one embodiment of the invention's design and integrated side handle, the top would not need very much glue. A few drops could keep the top major flaps down.

Figure 24:
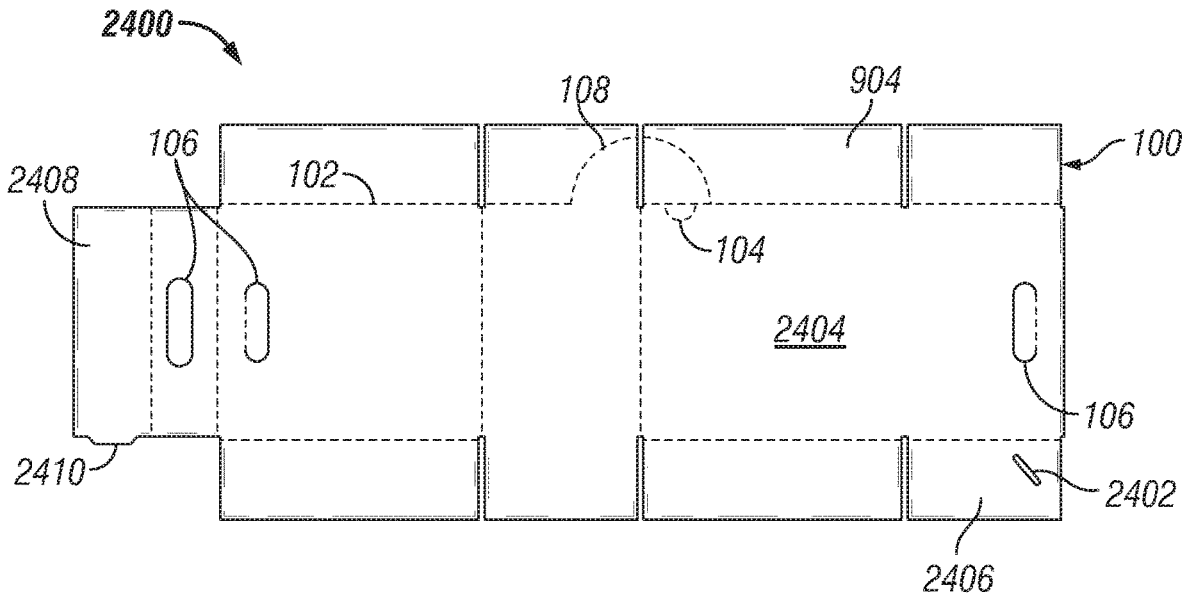
FIG. 24 shows a "die line" which represents where the cutting dies cut a Regular Slotted Carton box out of a sheet of corrugated paper, according to one or more aspects of the present disclosure.

FIG. 24 shows a "die line" in one embodiment of the invention which represent where cutting dies cut one embodiment of the invention out of a sheet of corrugated paper 100 (for example, card board) for an unassembled RSC box 2400. FIG. 24 illustrates an embodiment of an RSC box that includes a die line 102. The semi-circle 108 on the upper flap 904 is a pour spout which is removed by piercing circle 104 on a portion of the face 2404, for example, the portion that abuts the upper flap 904. A slit 2402 is disposed or formed in the flap 2406. The slit 2402 may be disposed or formed at any angle or position on the flap 2406, for example, at a forty-five degree angle near an edge of the flap 2406. A locking flap 2410 disposed or formed on a handle cavity flap 2408 locks with slit 2402 to secure the locking flap 2410 such that a liner can be inserted into the interior of the formed RSC box 2400 without manually holding the handle cavity flap 2408 in place.

Figure 25:
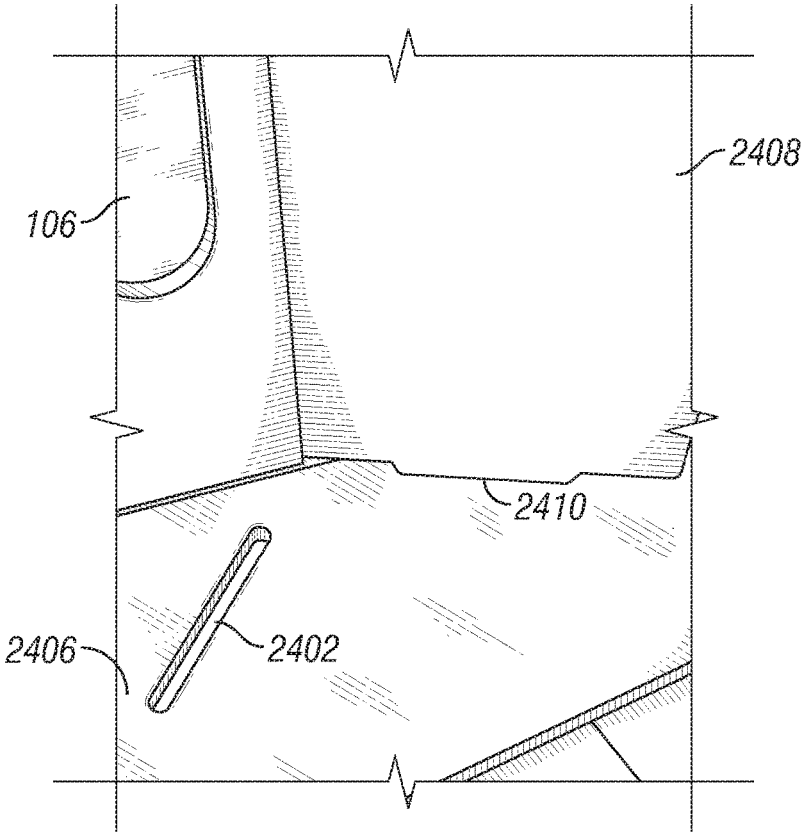
FIG. 25 shows a handle cavity flap with a tab in an unlocked position, according to one or more aspects of the present disclosure.
Figure 26:
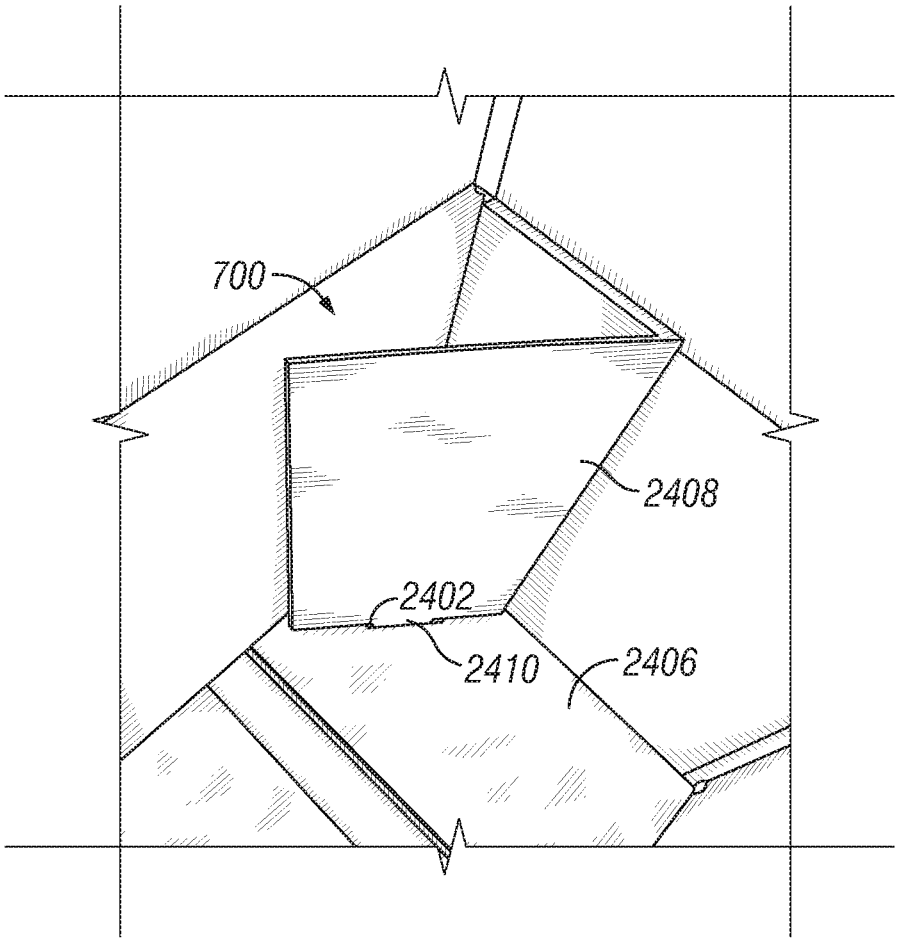
FIG. 26 shows a handle cavity flap with a tab in locked position, according to one or more aspects of the present disclosure.

FIG. 25 shows a partial view of a RSC box, for example, RSC box 2400 of FIG. 24, that includes a tab 2410 in handle cavity flap 2408 in an unlocked position such that a handle cavity is not formed, according to one or more aspects of the present disclosure. The tab 2410 is configured to lock in slit 2402 of the flap 2406 to secure the handle cavity flap 2408. For example, as illustrated in FIG. 26, the tab 2410 is secured in or extends into a die-cut slit or lock 2402 to form the handle cavity 700 and to lock the handle cavity flap 2408 in place. In the locked position, the handle cavity flap 2408 does not move freely, for example, such that handle cavity flap 2408 does not contact a liner disposed in the box which prevents damage to the liner, for example liner 900 of FIG. 9, during assembly of the box or use of the integrated handle, for example, integrated handle 600 of FIG. 6.

Figure 27:
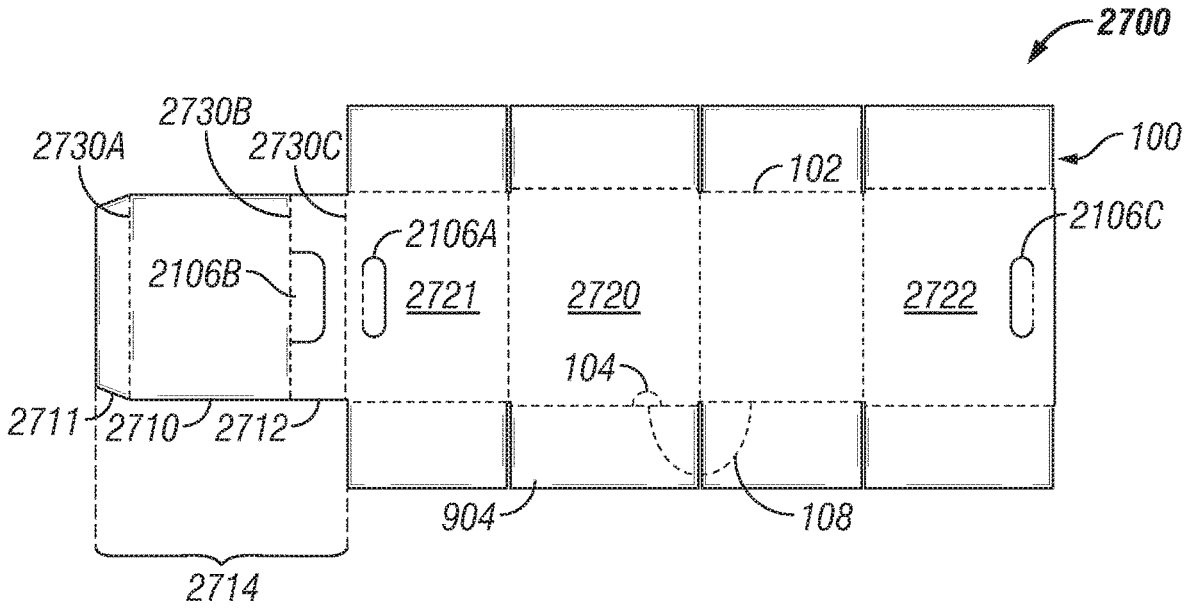
FIG. 27 shows a "die line" which represents where the cutting dies cut a Regular Slotted Carton box out of a sheet of corrugated paper, according to one or more aspects of the present disclosure.

FIG. 27 shows a "die line" in one embodiment of the invention which represents where cutting dies cut one embodiment of the invention out of a sheet of corrugated paper 100 (for example, card board) for an unassembled RSC box 2700. FIG. 27 illustrates an embodiment of an RSC box that includes a die line 102. The semi-circle 108 on the upper flap 904 is a pour spout which is removed by piercing circle 104 on a portion of the face 2720, for example, the portion that abuts the upper flap 904. In one or more embodiments, the semi-circle 108 may be any shape, for example, a semi-circle shape, an arc shape, a rectangular shape, a square shape, a trapezoidal shape, or any other shape that allows material to flow from the RSC box 2700. The three vertical hand hold cut-outs 2106A-C form a vertical hand hold which allows for the RSC box 2700 to have an integrated single handle, for example, similar to or the same as a handle formed by the cut-outs 106 discussed with respect to FIG. 1.

As illustrated in FIG. 27, the unassembled corrugated sheet 100 of the RSC box 2700 includes an internal support 2714. The internal support 2714 includes one or more portions, for example, a handle cavity flap 2710, a first binder flap 2711, and a second binder flap 2712. In one embodiment, the internal support 2714 may traverse from a face 2722 to a face 2720 that is opposite to the face 2722 within the cavity of the RSC box 2700 when the RSC box 2700 is assembled. In one embodiment, the internal support 2714 may traverse from the face 2722 to a face 2721 that is adjacent to the face 2722 within the cavity of the RSC box 2700 when the RSC box 2700 is assembled. The internal support 2714 may be at any angle or position relative to the face 2721 within the cavity of the RSC box 2700 when the RSC box 2700 is assembled. In one embodiment, the internal support 2714 may form a zigzag-shaped support within the cavity of the RSC box 2700 when the RSC box 2700 is assembled.

In one embodiment, the one or more portions of the internal support 2714 may be coupled or bound to the RSC box 2700. For example, the one or more portions of the internal support 2714 may be coupled or bound to one or more faces of the RSC box 2700 using a binder, for example, an adhesive, a fastener, a mating device, any other device that couples or secures the internal support 2714 to the RSC box 2700, and any combination thereof. In one embodiment, the first binder flap 2711 and the second binder flap 2712 are coupled to a first face and a second face, respectively, within the cavity formed when the RSC box 2700 is assembled. For example, the first binder flap 2711 may couple to the face 2720 and the second binder flap 2712 may couple to the face 2722 within the cavity formed when the RSC box 2700 is assembled.

The internal support 2714 includes a first perforation score 2730A, a second perforation score 2730B, and a third perforation score 2730C, collectively referred to as perforation score 2730. The first perforation score 2730A is disposed between the first binder flap 2711 and the handle cavity flap 2710. The second perforation score 2730B is disposed between the handle cavity flap 2710 and the second binder flap 2712. The third perforation score 2730C is disposed between the second binder flap 2712 and the face 2721. The one or more perforation scores 2730A-C may include one or more scores, apertures, or perforations. For example, the one or more perforation scores 2730A-C may penetrate through, partially through, or to any extent a face of the RSC box 2700. In one embodiment, the perforation score 2730A may facilitate the coupling of the first binder flap 2711 to the face 2720 by allowing a binder to infiltrate or secure to the perforation score 2730A. In one embodiment, one or more of the perforation scores 2730B and 2730C may facilitate the coupling of the second binder flap 2712 to the face 2722 by allowing a binder to infiltrate or secure to one or more of the perforation scores.

Figure 28:
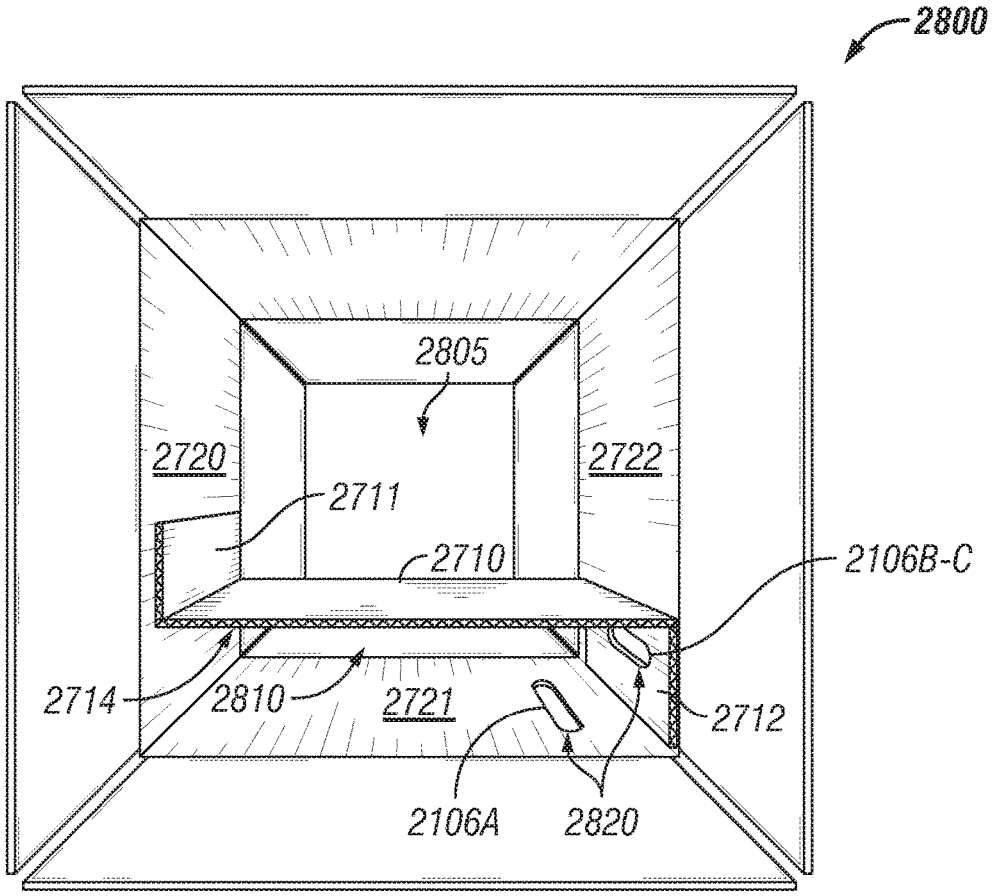
FIG. 28 shows an internal support forming a zigzag-shaped support, according to one or more aspects of the present disclosure.

FIG. 28 shows a partial view of an assembled RSC box 2800, for example, an RSC box assembled using a corrugated paper 100 similar to or the same as the corrugated paper 100 of RSC box 2700 discussed with respect to FIG. 27. RSC box 2800 includes an internal support 2714 traversing from a face 2722 to a face 2720 that is opposite to the face 2722, such that the internal support 2714 forms a zigzag-shaped support within the cavity 2805 of the RSC box 2800. The internal support 2714 that is secured forms a handle cavity 2810 enclosed by the handle cavity flap 2710 and the faces 2720, 2721, and 2722 within the cavity 2805 of the RSC box 2800. The internal support 2714 that is secured includes the handle cavity flap 2710 secured by the first binder flap 2711 coupled to the face 2720 and by the second binder flap 2712 coupled to the face 2722, such that the handle cavity 2810 is formed. The handle cavity 2810 may be any shape, for example, a rectangular shape, a square shape, a trapezoidal shape, or any other shape that prevents the handle cavity flap 2710 from moving freely within the RSC box 2800. For example, the handle cavity flap 2810 may be a rectangular shape so that the handle cavity flap 2710 does not damage, contact, or interfere with a liner (for example, liner 900 of FIG. 9) disposed in the RSC box 2800 during assembly of the box or use of an integrated handle 2820. The handle cavity 2810 separates the integrated handle 2820 from the cavity 2805 of the RSC box 2800.

The integrated handle 2820 includes a first vertical hand hold cut-out 2106A, a second vertical hand hold cut-out 2106B, and a third vertical hand hold cut-out 2106C, collectively referred to as vertical hand hold cut-out 2106. The first vertical hand hold cut-out 2106A is disposed on the face 2721 of the RSC box 2800. The second vertical hand hold cut-out 2106B is disposed on the second binder flap 2712 of the RSC box 2800. The third vertical hand hold cut-out 2106C is disposed on the face 2722 of the RSC box 2800. In one embodiment, the structural integrity of the integrated handle 2820 is further improved due to an overlap of the vertical hand hold cut-outs 2106B and 2106C, for example, overlapping the vertical hand hold cut-outs 2106B and 2106C to form a handle with two layers of the corrugated paper 100. In one embodiment, one or more of the vertical hand hold cut-outs 2106A-C may include a same or similar shape. In one embodiment, one or more of the vertical hand hold cut-outs 2106A-C may include an oval-shape, a rectangular shape, a rounded-shape, any other shape that allows the vertical hand hold cut-outs 2106A-C to form an integrated handle 2820, and any combination thereof. In one embodiment, one or more of the vertical hand hold cut-outs 2106A-C may include one or more edges that are squared, rounded, or any combination thereof.

An embodiment of the present disclosure is a container for use with a transportable material that includes: an outer surface that encloses a cavity; a first face internal to the container; a second face internal to the container; a third face internal to the container; a fourth face internal to the container; an integrated handle including a first aperture disposed in the first face internal to the container and a second aperture disposed in the second face internal to the container and proximate to the first aperture; and an internal support disposed in the cavity, wherein the internal support traverses the cavity of the container to form a handle cavity by extending from the first face internal to the container to one or more of the second face internal to the container, the third face internal to the container, and the fourth face internal to the container, wherein the internal support includes a handle cavity flap, a first binder flap, and a second binder flap.

In one or more embodiments described in the preceding paragraph, the container further includes a pour spout disposed on an upper flap of the container where the third face internal to the container intersects the fourth face internal to the container. In one or more embodiments described in the preceding paragraph, the integrated handle is disposed where the first face internal to the container intersects the second face internal to the container that is opposite to the pour spout. In one or more embodiments described in the preceding paragraph, the first binder flap and the second binder flap are coupled to one or more of the second face internal to the container, the third face internal to the container, and the fourth face internal to the container to secure the internal support. In one or more embodiments described in the preceding paragraph, the container further includes one or more perforation scores disposed or scored on one or more faces internal to the container. In one or more embodiments described in the preceding paragraph, the internal support forms a zigzag-shaped support within the cavity of the container. In one or more embodiments described in the preceding paragraph, the container further includes a liner disposed within the outer surface to define a lined cavity within the cavity of the container. In one or more embodiments described in the preceding paragraph, a portion of the liner is pullable through the pour spout. In one or more embodiments described in the preceding paragraph, the pour spout includes a notch, wherein the notch allows the portion of the liner to be pulled through the pour spout, and a cleat that secures the portion of the liner. In one or more embodiments described in the preceding paragraph, the pour spout includes an "X" shaped closure that allows the portion of the liner to be pulled through the pour spout.

An embodiment of the present disclosure is a method that includes: creating a container that includes providing an outer surface configured to enclose a cavity; providing a first face internal to the container; providing a second face internal to the container; providing a third face internal to the container; providing a fourth face internal to the container; providing an integrated handle including: a first aperture disposed in the first face internal to the container; and a second aperture disposed in the second face internal to the container and proximate to the first aperture; and providing an internal support disposed in the cavity, wherein the internal support traverses the cavity of the container to form a handle cavity by extending from the first face internal to the container to one or more of the second face internal to the container, the third face internal to the container, and the fourth face internal to the container, wherein the internal support includes a handle cavity flap, a first binder flap, and a second binder flap.

In one or more embodiments described in the preceding paragraph, forming a pour spout on an upper flap of the container where the third face internal to the container intersects the fourth face internal to the container. In one or more embodiments described in the preceding paragraph, the integrated handle is disposed where the first face internal to the container intersects the second face internal to the container that is opposite to the pour spout. In one or more embodiments described in the preceding paragraph, the first binder flap and the second binder flap are coupled to one or more of the second face internal to the container, the third face internal to the container, and the fourth face internal to the container to secure the internal support. In one or more embodiments described in the preceding paragraph, providing one or more perforation scores on one or more faces internal to the container. In one or more embodiments described in the preceding paragraph, the internal support forms a zigzag-shaped support within the cavity of the container. In one or more embodiments described in the preceding paragraph, providing a liner within the outer surface to define a lined cavity within the cavity of the container. In one or more embodiments described in the preceding paragraph, a portion of the liner is pullable through the pour spout. In one or more embodiments described in the preceding paragraph, the pour spout includes a notch, wherein the notch allows the portion of the liner to be pulled through the pour spout, and a cleat that secures the portion of the liner. In one or more embodiments described in the preceding paragraph, the pour spout includes an "X" shaped closure that allows the portion of the liner to be pulled through the pour spout.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A container for use with a transportable material, comprising:

an outer surface that encloses a cavity;
a first face internal to the container;
a second face internal to the container;
a third face internal to the container;
a fourth face internal to the container;
an integrated handle comprising:
a first aperture disposed in the first face internal to the container; and
a second aperture disposed in the second face internal to the container and proximate to the first aperture;
an internal support disposed in the cavity, wherein the internal support traverses the cavity of the container to form a handle cavity by extending from the first face internal to the container to one or more of the second face internal to the container, the third face internal to the container, and the fourth face internal to the container, wherein the internal support comprises a handle cavity flap, a first binder flap, and a second binder flap; and
a pour spout disposed on an upper flap of the container where the third face internal to the container intersects the fourth face internal to the container.

2. The container for use with a transportable material of claim 1, wherein the integrated handle is disposed where the first face internal to the container intersects the second face internal to the container that is opposite to the pour spout.

3. The container for use with a transportable material of claim 2, wherein the first binder flap and the second binder flap are coupled to one or more of the second face internal to the container, the third face internal to the container, and the fourth face internal to the container to secure the internal support.

4. The container for use with a transportable material of claim 3, further comprising one or more perforation scores disposed or scored on one or more faces internal to the container.

5. The container for use with a transportable material of claim 4, wherein the internal support forms a zigzag-shaped support within the cavity of the container.

6. The container for use with a transportable material of claim 1, further comprising a liner disposed within the outer surface to define a lined cavity within the cavity of the container.

7. The container for use with a transportable material of claim 6, wherein a portion of the liner is pullable through the pour spout.

8. The container for use with a transportable material of claim 7, wherein the pour spout comprises:

a notch, wherein the notch allows the portion of the liner to be pulled through the pour spout; and
a cleat that secures the portion of the liner.

9. The container for use with a transportable material of claim 7, wherein the pour spout comprises an "X" shaped closure that allows the portion of the liner to be pulled through the pour spout.

10. A method for creating a container, comprising:

providing an outer surface configured to enclose a cavity;
providing a first face internal to the container;
providing a second face internal to the container;
providing a third face internal to the container;
providing a fourth face internal to the container;
providing an integrated handle comprising:
a first aperture disposed in the first face internal to the container; and
a second aperture disposed in the second face internal to the container and proximate to the first aperture;
providing an internal support disposed in the cavity, wherein the internal support traverses the cavity of the container to form a handle cavity by extending from the first face internal to the container to one or more of the second face internal to the container, the third face internal to the container, and the fourth face internal to the container, wherein the internal support comprises a handle cavity flap, a first binder flap, and a second binder flap; and
forming a pour spout on an upper flap of the container where the third face internal to the container intersects the fourth face internal to the container.

11. The method for creating the container of claim 10, wherein the integrated handle is disposed where the first face internal to the container intersects the second face internal to the container that is opposite to the pour spout.

12. The method for creating the container of claim 11, wherein the first binder flap and the second binder flap are coupled to one or more of the second face internal to the container, the third face internal to the container, and the fourth face internal to the container to secure the internal support.

13. The method for creating the container of claim 12, further comprising providing one or more perforation scores on one or more faces internal to the container.

14. The method for creating the container of claim 13, wherein the internal support forms a zigzag-shaped support within the cavity of the container.

15. The method for creating the container of claim 10, further comprising providing a liner within the outer surface to define a lined cavity within the cavity of the container.

16. The method for creating the container of claim 15, wherein a portion of the liner is pullable through the pour spout.

17. The method for creating the container of claim 16, wherein the pour spout comprises:

a notch, wherein the notch allows the portion of the liner to be pulled through the pour spout; and a cleat that secures the portion of the liner.

18. The method for creating the container of claim 16, wherein the pour spout comprises an "X" shaped closure that allows the portion of the liner to be pulled through the pour spout.

* * * * *